US008286871B2

(12) United States Patent
Bay

(10) Patent No.: US 8,286,871 B2
(45) Date of Patent: Oct. 16, 2012

(54) ELECTRONIC ARCHERY SIGHTING SYSTEM AND BORE SIGHTING ARROW

(75) Inventor: Larry Bay, Renton, WA (US)

(73) Assignee: Clean Shot Archery, Inc., Kent, WA (US)

( * ) Notice: Subject to any disclaimer, the term of this patent is extended or adjusted under 35 U.S.C. 154(b) by 50 days.

(21) Appl. No.: 12/757,893

(22) Filed: Apr. 9, 2010

(65) Prior Publication Data

US 2010/0258628 A1 Oct. 14, 2010

Related U.S. Application Data

(60) Provisional application No. 61/168,105, filed on Apr. 9, 2009.

(51) Int. Cl.
*G06F 19/00* (2011.01)
*G06G 7/80* (2006.01)

(52) U.S. Cl. ..... 235/404; 235/407

(58) Field of Classification Search ..... 234/404, 234/414; 33/265; 42/111
See application file for complete search history.

(56) References Cited

U.S. PATENT DOCUMENTS 3,641,675 A 2/1972 Funk, Jr.
4,340,930 A 7/1982 Carissimi
4,547,837 A 10/1985 Bennett
RE32,123 E 4/1986 Knight
5,134,552 A 7/1992 Call et al.
5,141,229 A 8/1992 Roundy
5,175,651 A 12/1992 Marron et al.
5,419,050 A 5/1995 Moore
5,634,278 A 6/1997 London
5,871,410 A 2/1999 Simo et al.
6,005,719 A 12/1999 Rando
6,029,120 A * 2/2000 Dilger ..... 702/142
6,040,566 A 3/2000 Rioland et al.
6,077,179 A 6/2000 Liechty, II
6,123,631 A 9/2000 Ginder
6,134,793 A 10/2000 Sauers
6,165,086 A 12/2000 Liechty, II
6,171,206 B1 1/2001 Liechty, II
6,258,000 B1 7/2001 Liechty, II
6,287,223 B1 9/2001 Liechty, II (Continued)

OTHER PUBLICATIONS

Ahlers et al., "Calibration Requirements and Procedures for a Monitorbased Augmented Reality System", IEEE Transactions on Visualization and Computer Graphics, 1(3): 255-273; Jul. 6, 1995; 32 pages.

(Continued)

*Primary Examiner* — Thien M Le
*Assistant Examiner* — Christopher Stanford
(74) *Attorney, Agent, or Firm* — Skaar Ulbrich Macari, P.A.

(57) ABSTRACT

An archery sighting system and method for placing a reticule on a display. The system includes a housing mounted in fixed relation to a bow. The housing includes a rangefinder to generate a target distance signal indicative of a target distance between the bow and a target. A display is configured to depict a reticule. A chronograph generates a bow speed indicating a bow speed at which an arrow leaves the bow. A processor receives a bow speed signal from the chronograph, a range signal from the rangefinder. In response to the signals, the processor generates a reticule pattern on the display, the reticule is positioned to indicate an attitude of the bow necessary for an arrow released from the bow at the bow speed to strike a target at the target distance.

20 Claims, 8 Drawing Sheets

U.S. PATENT DOCUMENTS

| | | | |
|---|---|---|---|
| 6,287,224 | B1 | 9/2001 | Liechty, II |
| 6,306,053 | B1 | 10/2001 | Liechty, II |
| 6,366,344 | B1 | 4/2002 | Lach |
| 6,390,642 | B1 | 5/2002 | Simonton |
| 6,409,617 | B1 | 6/2002 | Armold |
| 6,428,433 | B1 | 8/2002 | Liechty, II |
| 6,428,434 | B1 | 8/2002 | Liechty, II |
| 6,490,060 | B1 | 12/2002 | Tai et al. |
| 6,526,666 | B1 | 3/2003 | Lastinger, Jr. |
| 6,622,392 | B1 | 9/2003 | Bourget |
| 6,743,128 | B2 | 6/2004 | Liechty, II |
| 6,755,758 | B2 | 6/2004 | Liechty, II |
| 6,758,774 | B2 | 7/2004 | Liechty, II |
| 6,851,197 | B2 | 2/2005 | Terry et al. |
| 6,997,716 | B2 | 2/2006 | Skala et al. |
| 7,162,806 | B1 | 1/2007 | Swiggart |
| 7,216,643 | B2 | 5/2007 | Pellerite |
| 7,231,721 | B2 | 6/2007 | Minica et al. |
| 7,268,488 | B2 | 9/2007 | Ryu |
| 7,313,871 | B2 | 1/2008 | Lines et al. |
| 7,316,625 | B2 | 1/2008 | Takahashi |
| 7,409,770 | B2 | 8/2008 | Jones |
| 7,837,580 | B2 | 11/2010 | Huang et al. |
| 7,972,230 | B2 | 7/2011 | Donahoe |
| 8,091,268 | B2 | 1/2012 | York |
| 2002/0197584 | A1 | 12/2002 | Kendir et al. |
| 2004/0014010 | A1 | 1/2004 | Swensen et al. |
| 2005/0246910 | A1* | 11/2005 | Mowers ..... 33/266 |
| 2005/0252062 | A1* | 11/2005 | Scrogin et al. ..... 42/119 |
| 2005/0278964 | A1 | 12/2005 | Minica et al. |
| 2007/0137088 | A1* | 6/2007 | Peters et al. ..... 42/111 |
| 2008/0010842 | A1* | 1/2008 | Jones ..... 33/265 |
| 2009/0309492 | A1* | 12/2009 | Hofmann et al. ..... 313/504 |

OTHER PUBLICATIONS

Navab et al., in "Single Point Active Alignment Method (SPAAM) for Calibrating an Optical See-through Head Mounted Display", Proc. of the IEEE International Symposium on Augmented Reality, ISAR '00, Munich, Germany; Oct. 2000; 10 pages.

Sauer et al., "Augmented Workspace: Designing an AR Testbed", Proc. of the IEEE International Symposium on Augmented Reality, ISAR '00, Munich, Germany, Oct. 2000; 7 pages.

Poston et al., "Dextrous Virtual Work", Communication of the ACM, vol. 39, No. 5, May 1996; pp. 37-45; 9 pages.

Koller et al., "Real-time Vision-Based Camera Tracking for Augmented Reality Applications", ACM, Sep. 15, 1997, pp. 87-94 (8 pages).

Billinghurst et al., "The Expert Surgical Assistant: An Intelligent Virtual Environment with Multimodal Input", Proceedings of Medicine Meets Virtual Reality IV; 1996; pp. 590-607 (16 pages).

* cited by examiner

Traditional Mode
(No Electronic Adjustments)

Automatic - Hunting Mode
(Adjusted for Broadheads)

Automatic - Practice Mode
(Adjusted for Field Points)

ELECTRONIC ARCHERY SIGHTING SYSTEM AND BORE SIGHTING ARROW

PRIORITY CLAIM AND RELATED APPLICATION

This application claims priority to commonly co-owned provisional application Ser. No. 61/168,105 filed on Apr. 9, 2009, which is hereby incorporated by reference. Additionally, an arrow suitable for use with the present electronic archery sight is provided in the co-owned, co-pending U.S. patent application Ser. No. 12/757,401, entitled, "Arrowhead With Laser", the entire disclosure of which is hereby incorporated by reference.

FIELD OF THE INVENTION

This invention relates generally to archery sighting technology and, more specifically, to electronic sighting.

BACKGROUND OF THE INVENTION

Archery sights today typically include a mechanical device mounted on a bow that has one or more pins that an archer looks across at a target to properly aim the bow. Sometimes the pins include an optic fiber that illuminates to make the pin stand out in the archer's view. In addition, some sights include a peep sight mounted to the bowstring that gives the archer two points to align, one on the bowstring and one on the sight mounted to the bow. This typically improves sighting accuracy up to 20%. The angle at which an archer holds a bow to hit a target varies based on the distance of the archer from the target and the speed of the bow (e.g., in feet per second). Sights often account for this by included several mechanical pins, each dedicated to a particular range (e.g., 10-25 yards, 25-50 yards, and so forth).

Unfortunately, modern sights have several drawbacks. For example, they are often heavy mechanical devices that weigh down the bow and increase archer fatigue, which may decrease shot accuracy over time. In addition, fiber optic pins often bend or break, resulting in decreased accuracy and ultimately replacement of the sight. Moreover, even upon making a great shot, an archer often has difficulty locating the arrow. Not only may the arrow have strayed from where the archer aimed it, but the arrow may also have hit an animal or other moving target that changes position after the shot.

For example, there have been several suggested solutions that employ an augmented reality display that can impose over a generated view of the downrange target with, at least, an appropriate reticule superimposed over the display of the downrange target for the purpose of suitably isolating and marking the target without reference to an actual hardware embodiment of pins or, alternately, a network of fine lines, wires, or the like placed in the focus at the eyepiece of an optical instrument placed at the focus. For example, U.S. Pat. No. 7,162,806 entitled "Video Sighting System' granted to Swiggart on Jan. 16, 2007 envisions a video display and camera on a single mount such that the video display simply portrays what would be ordinarily visible to the eye from the general area of the rest. By overlaying mechanical pins, the sight performs much as it might without the video system.

SUMMARY OF THE INVENTION

The archery sighting system solves several problems for archers by combining existing technologies into a single sighting system to improve shot accuracy. In some exemplary embodiments, the system captures the shot on digital video. One embodiment includes a range finder with slope detect technology to aid the archer in selecting the proper distance to the target even with inclined and declined topography. In another exemplary embodiment, a chronograph determines the speed of the arrow (e.g., in feet per second) to help tune the bow automatically. In additional embodiments, a display of the sighting system includes touch screen capabilities and electroluminescent technology to allow the archer to see-through the display. The display automatically adjusts an electronic dot based on the speed of the bow and the distance to the target. A digital camera with zoom capabilities captures video footage of the shot. The arrow for the sighting system includes a forward-mounted laser to illuminate the target with a built in 3-axis accelerometer to automatically turn the arrow on and off. The rear section of the arrow or (nock) illuminates after the shot to aid the archer in retrieving the arrow. In some embodiments, the rear facing LED also includes an IR transmitter to wirelessly send the flight information back to a separate receiver. The hunting blades can be removed to allow the archer to use the sighting system for practice, 3D/traditional archery tournaments, and small game hunting.

The present invention comprises an archery sighting system and method for placing a reticule on a display. The system includes a housing mounted in fixed relation to a bow. The housing includes a rangefinder to generate a target distance signal indicative of a target distance between the bow and a target. A display is configured to depict a reticule. A chronograph generates a bow speed indicating a bow speed at which an arrow leaves the bow. A processor receives a bow speed signal from the chronograph, a range signal from the rangefinder. In response to the signals, the processor generates a reticule pattern on the display, the reticule is positioned to indicate an attitude of the bow necessary for an arrow released from the bow at the bow speed to strike a target at the target distance.

These and other examples of the invention will be described in further detail below.

BRIEF DESCRIPTION OF THE DRAWINGS

Preferred and alternative examples of the present invention are described in detail below with reference to the following drawings:

FIG. 6 is a flow chart of a method for setting electronic pins in an embodiment of the sighting system.

DETAILED DESCRIPTION OF THE PREFERRED EMBODIMENT

An archery sighting system is described herein that provides an electronic adjustable sighting device as well as technology that can be included in an arrow to improve shot accuracy and arrow/target recovery. Throughout this application, reference is made to the sport of archery and this sighting system is described to include a bow and an arrow. There is nothing that limits the use of the sighting system to archery applications. It is envisioned that, for example, the same system might be used to aim a rifle or handgun; automatic weaponry, such as an automatic rifle; or even a cross-bow. The archery example has been selected as a non-limiting means of explaining more universal principles that are shared in use on any ballistic weapon. For example, the relation of the mount to the sighting system and thus to the weapon is the same whether the weapon is a black-powder rifle or, as here, a bow. Bore-sighting is, likewise, bore-sighting whether on a rifle or, as here, on a bow. This invention is not, therefore, limited to archery applications.

Figure 1:
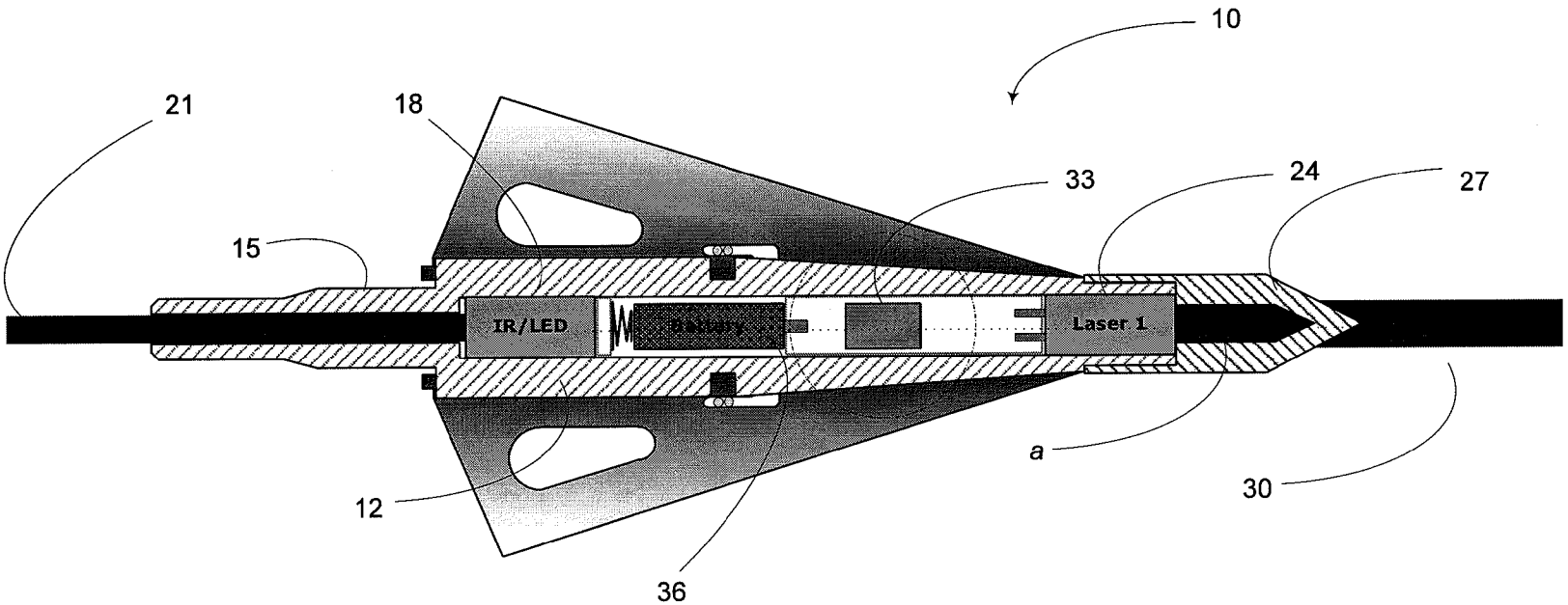
FIG. 1 is a cross-sectional diagram that illustrates an arrow used with the system, in one embodiment.

FIG. 1 is a cross-sectional diagram that illustrates an arrow used with the system, in one nonlimiting embodiment. The bore sighting laser arrow 10 includes, arranged within and on an aft end of a hollow shaft 12, a light transmitting nock assembly 15, an LED/IR transmitter 18 arranged to transmit a beam of IR light 21 through the light transmitting nock assembly 15, and a laser beam 3. The LED/IR transmitter includes both non-coherent and coherent (or laser emitting) diodes and the use of LED is not meant to limit the invention to non-coherent light sources. On a forward end of the shaft 12, a laser 24 is arranged to project a laser beam 30 through a light transmitting head assembly 27 along a principle axis a of the shaft 12, just as the LED/IR transmitter projects the beam of IR light along a in the aft direction. The light transmitting head assembly, in one exemplary embodiment, includes a laser enhancement lens filter (not shown) that enhances the projection of the laser beam 30 downrange along the axis a.

Within the shaft 12 (shown here only as a portion of the arrowhead but extending through the bore sighting laser arrow 10), a processor 33 includes at least one accelerometer (not shown) oriented to measure at least acceleration along the axis a. The inventive arrow includes a power source 36. In one presently preferred embodiment that power source is a battery producing an electrical current by means of chemical reaction such as Nickel metal hydride, Lithium Ion or Alkaline batteries. In another embodiment, a high capacity capacitor will also suitably serve as a power source as the need for large amounts of power is only of very short duration, during the nocking, flight, and immediate aftermath of the flight. One advantage of a capacitor is the very rapid charging that can occur in a charging quiver assembly.

Figure 2C:
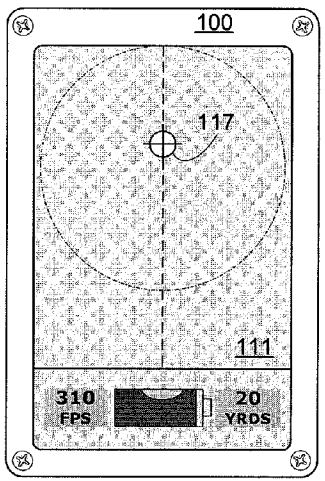
FIG. 2*c* shows an archer-side view of the embodiment of the sighting system.
Figure 2B:
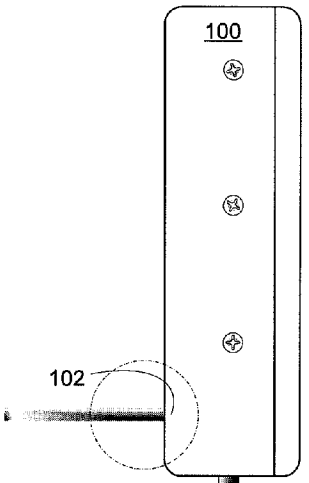
FIG. 2*b* shows a downrange-side view of an embodiment of the sighting system.
Figure 2B:
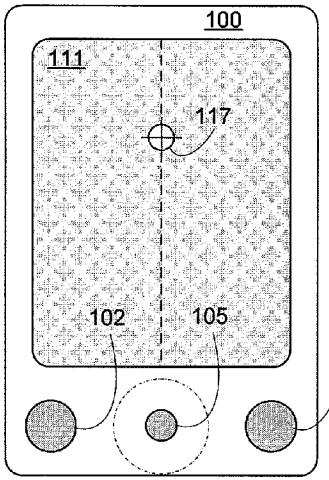
Figure 2A:
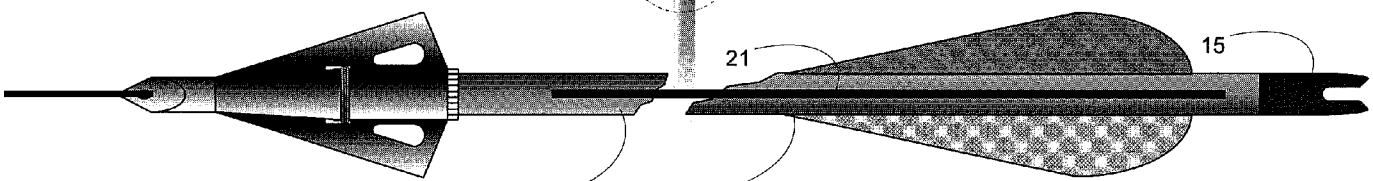
FIG. 2*a* portrays a data flow diagram showing interaction between the arrow and a sighting system.
Figure 2D:
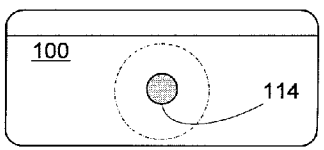
FIG. 2*d* is a bottom-view of the embodiment of the sighting system.

Referring to FIGS. 1 and 2*a*, in use, the bore sighting laser arrow 10 interacts with an inventive aiming system 100 (shown in side view) to calibrate the system and for verification of calibration based upon the flight of the arrow. As stated above, the processor 120 includes an accelerometer. Throughout the application, the term processor 33 is not limited to a traditional CPU but encompasses an entire processing unit which might be suitably constructed as a single large-scale integrated circuit or may include a circuit board with a distinct memory chip, at least one accelerometer, busses for data and other known configurations to support the described operations. In one embodiment, the accelerometer includes at least one 3-axis accelerometer, in alternate embodiments, the functions supplied by the at least one 3-axis accelerometer may, instead, be implemented by a single accelerometer in each of three orthogonal axes oriented such that one aligns with the axis a. In a minimal embodiment of the invention, a single axis accelerometer aligned along the axis a will suffice to measure arrow speed along with the other displacement functions of the instant invention, though the single axis accelerometer is not presently preferred.

In one of the 3-axis embodiments, the accelerometer can further enable a "tap technology" to turn the components on or off. By tap technology, the applicant is expressing the means for activation a switch in response to a concussive blow to the bore sighting laser arrow 10 sufficient to impart an acceleration the accelerometer can sense. In response to the blow, the signal generated within the processor can suitably activate or deactivate functions of the bore sighting laser arrow 10. By way of non-limiting example, the laser may be suitably activated prior to or in the course of nocking the arrow by a tap orthogonal to axis a.

Another purpose of the accelerometer is to detect the speed of the arrow (e.g., in feet per second (FPS)). Thus, in a scenario for use, the laser 24 is turned on in response to a suitable tap by the user and then nocked to orient the arrow for flight. Because the laser is used for calibration of the system 100 and only relevant during nocking and the residence of the arrow against the arrow rest prefatory to actual flight, the laser 24 remains on until the processor 33 it turns off when the arrow reaches or exceeds a designatable speed (e.g., 150 FPS). The processor 33 may also, optionally, activate the LED/IR transmitter 18 when the arrow after initial acceleration in flight, slows to a designatable speed (e.g., 150 FPS) and thus projects a signal through the light transmitting nock assembly 15 back to the system 100. In a presently preferred embodiment, the bore sighting laser arrow 10, by means of the LED/IR transmitter 18 will send the accelerometer signal either in a raw or a processed state depending upon the specific embodiment, that data being indicative of the arrow flight acceleration data; the transmission through the light transmitting nock assembly being beamed back to a the system 100 by means of an IR receiver 102 the system 100 comprises.

In still another embodiment of the bore sighting laser arrow 10 interacting with the system, the processor 33 will, after the bore sighting laser arrow 10 has reached a designatable speed (e.g., 150 feet per second) during the speed decay of the bore sighting laser arrow 10 flight, activate the LED/IR transmitter 18, which will transmit the IR beam 21 down through the shaft of the arrow and through the light transmitting nock assembly 15. The IR beam provides a good visual tracking system for arrows during flight and allows for easy recovery of the bore sighting laser arrow 10 after the shot. The bore sighting laser arrow 10 transmitting the IR beam 21 through the light transmitting nock assembly 15 provides a beacon that can be identified with the IR receiver 102. Iterative passes over an area will provide very good directionality of the signal source emanating through the light transmitting nock 15.

The receiver 102 assists the archer in the recovery of the arrow and also receives IR beam 21 that is modulated to transmit data obtained by processor 33 characterizing the bore sighting laser arrow 10 in flight. By at least this means the system is able to obtain flight data which may include acceleration along axis a as well as any components of acceleration that are normal or orthogonal to axis a. The archery sighting system 10 allows an archer to project the laser beam along the axis a to provide a single laser dot on a target. For example, for bows that shoot over 275 FPS, the laser dot may be accurate out to 30-yards.

FIGS. 2*b* and 2*c*, illustrate rear and front view, respectively of the inventive archery sighting system 100 in a presently preferred embodiment shaped and sized to emulate mechanical sights—other embodiments are also possible which will achieve the ends of the instant invention though emulating the current mechanical sights is thought to allow rapid intuitive transfer to use of the instant archery sighting system by archers trained on the mechanical sight. For example, an archer may attach the sighting system 100 to the bow in place of a traditional sighting device. Because it occupies a similar form factor, in the presently preferred embodiment, the archer instinctively handles a bow with the instant system 100 in a manner, when, for example, passing through dense brush so as to preserve the system 100 on its mount in a calibrated position.

Referring to FIGS. 2*a*, 2*b*, 2*c*, and 2*d*, in one preferred embodiment, the sighting system 100 includes a digital camera 105, a laser range finder 108, and a display 111. Optionally the system 100 includes a chronograph ma gnetic sensor 114, in accord with that granted to Dilber on Feb. 22, 2000 as U.S. Pat. No. 6,029,120 and entitled, "BOW-MOUNTED CHRONOGRAPH" incorporated herein as if fully set out herein by this reference. The chronograph includes the magnetic sensor 114, in one embodiment includes a nonlatching magnetic sensor with a Schmitt trigger output. The magnetic sensor 114 senses the presence of two permanent magnets mounted in fixed distance along axis a which together form a dual, opposite-pole magnetic trigger assembly. The first permanent magnet is oriented such that the north pole is placed outward from the surface of the nonmagnetic arrow shaft 12 and the second permanent magnet is placed with the south pole outward from arrow shaft 12. The required magnetic orientation of permanent magnets is achieved using the electronic sensor 114 provided in chronograph. As the magnets pass under the magnetic sensor 114 in a fixed geometric relation, the temporal interval is directly proportionate to the speed of the bore sighting laser arrow 10 as it leaves the rest. One such chronograph or magnetic sensor might be a Hall Effect sensor.

The chronograph works by timing the interval between a passage of a first chronograph reference on an arrow past the chronograph sensor and a passage of a second chronograph reference on the arrow past the chronograph sensor. As the arrow leaves the bow at speed, the interval is inversely proportionate to bow speed. An optical analogue wherein the references are markings of a color and the sensor is a filtered light and photocell assembly might serve as easily as the described Hall Effect sensor might work in an equivalent analogue to sense the speed of an arrow as it leaves the rest without changing the operation of the invention. Other analogues are readily found in the field of ignition timing for internal combustion engines, the task being largely similar. Data provided the system 100 by the sensor 114 is used either to supplement the data from the accelerometer in the bore sighting laser arrow 10 or in lieu of it such that after calibration, the system 100 will function entirely without the bore sighting laser arrow 10 based upon the speed data received at the sensor 114.

Referring to FIGS. 2*b* and 2*c*, the presently preferred embodiment includes the display 111 that provides an image of a reticule 117 for display of an analogue to the physical pins of metal sights. In the presently preferred embodiment, the display is formed as is taught in accord with that granted to Ryu on Sep. 11, 2007 as U.S. Pat. No. 7,268,488 and entitled, "DISPLAY DEVICE AND MOBILE DISPLAY HAVING A SEMI-TRANSPARENT METAL LAYER" especially as set forth in the transparent embodiment set forth there which is incorporated herein as if fully set out herein by this reference. Transparent OLEDs have only transparent components (substrate, cathode and anode) and, when turned off, are up to 85 percent as transparent as their substrate. When a transparent OLED display 111 is turned on, it allows light to pass in both directions. A transparent OLED display 111 can be either active- or passive-matrix. Because of the transparency of the display 111, it, too, can be readily used by an archer familiar with the mechanical sights as the reticule serves in the instant invention.

Transparent OLED displays have the further advantage that they can be suitably coated to enhance the performance of the nonactivated portions of the transparent OLED display 111. For example, the OLED display may be suitably coated with a filter coating that might, advantageously, shift in neutral density filtering of light in response to ambient light to allow the archer a better view of the target. Other alternate coating might be oleophobic coating, to prevent accumulation of oils and other debris entrapped in oils; nonscratch coating, and even diopter corrective lenses to enhance the downrange view. Additional colored filters might be advantageously used to make the filter more useful in specific environments such as in snowy environments to make the target stand out relative to the background.

The Samsung Mobile Display Corporation exhibited a suitable transparent screen at the 2010 Pepcom's Digital Experience! press event during the Consumer Electronic Show, at the Mirage Hotel on Wednesday on January $6^{th}$. The transparent OLED panel prototype, was designed for use in applications from smartphones, MP3s and very low power usage notebook computers to 'head-up' displays for vehicles, and advertisement displays that are interactive and eye-catching. Not only has Samsung demonstrated that when energized clear transparency when energized and even when unpowered, the prototype has up to a 40% transparency. The transparent OLED represents the highest resolution on the largest screen with high transparency, and is clearly adaptable to the instant invention.

In an alternate embodiment of the display, the sighting system 100 includes the digital camera 105 automatically starts recording when the range finder 108 has "locked" onto the target. In such a manner, the digital camera 105 can be suitably employed to present the same augmented reality experience as the presently preferred embodiment provides to the archer. An augmented reality system incorporates input garnered from a number of sensors to create suitable information cues to be projected upon an image thereby to generate a composite image that bears more information to be positioned in a manner to give geospatial meaning to the presentation of that information. The operation of the elements typically employed in an augmented reality system as well as the calibration required of such a system is described by: Ahlers et al., in "Calibration Requirements and Procedures for a Monitor-based Augmented Reality System", IEEE Transactions on Visualization and Computer Graphics, 1(3): 255-273, 1995; Navab et al., in "Single Point Active Alignment Method (SPAAM) for Calibrating an Optical See-through Head Mounted Display", Proc. of the IEEE International Symposium on Augmented Reality, ISAR '00, Munich, Germany, October 2000; Sauer et al., "Augmented Workspace: Designing an AR Testbed", Proc. of the IEEE International Symposium on Augmented Reality, ISAR '00, Munich, Germany, October 2000; Poston et al., Dextrous Virtual Work, May 1996, Communication of the ACM, vol.

39, No. 5, pp. 37-45; and Koller et al., Real-time Vision-Based Camera Tracking for Augmented Reality Applications, ACM, 1997, pp. 87-94; Billinghurst et al., The Expert Surgical Assistant: An Intelligent Virtual Environment with Multimodal Input, Proceedings of Medicine Meets Virtual Reality IV, pp. 590-607.

Figure 3:
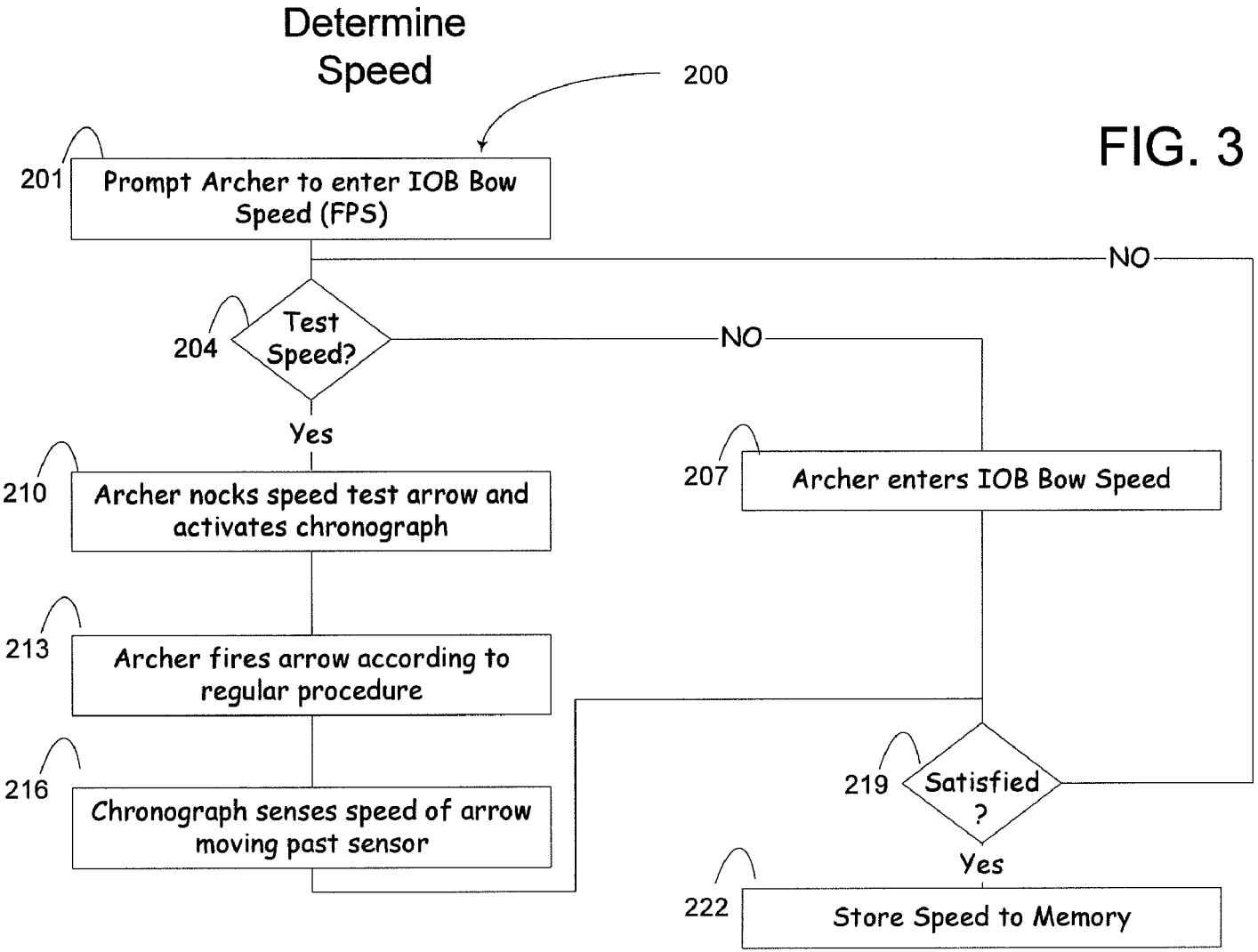
FIG. 3 is a flow chard of a method of determining a bow speed of a bow and archer.
Figure 4:
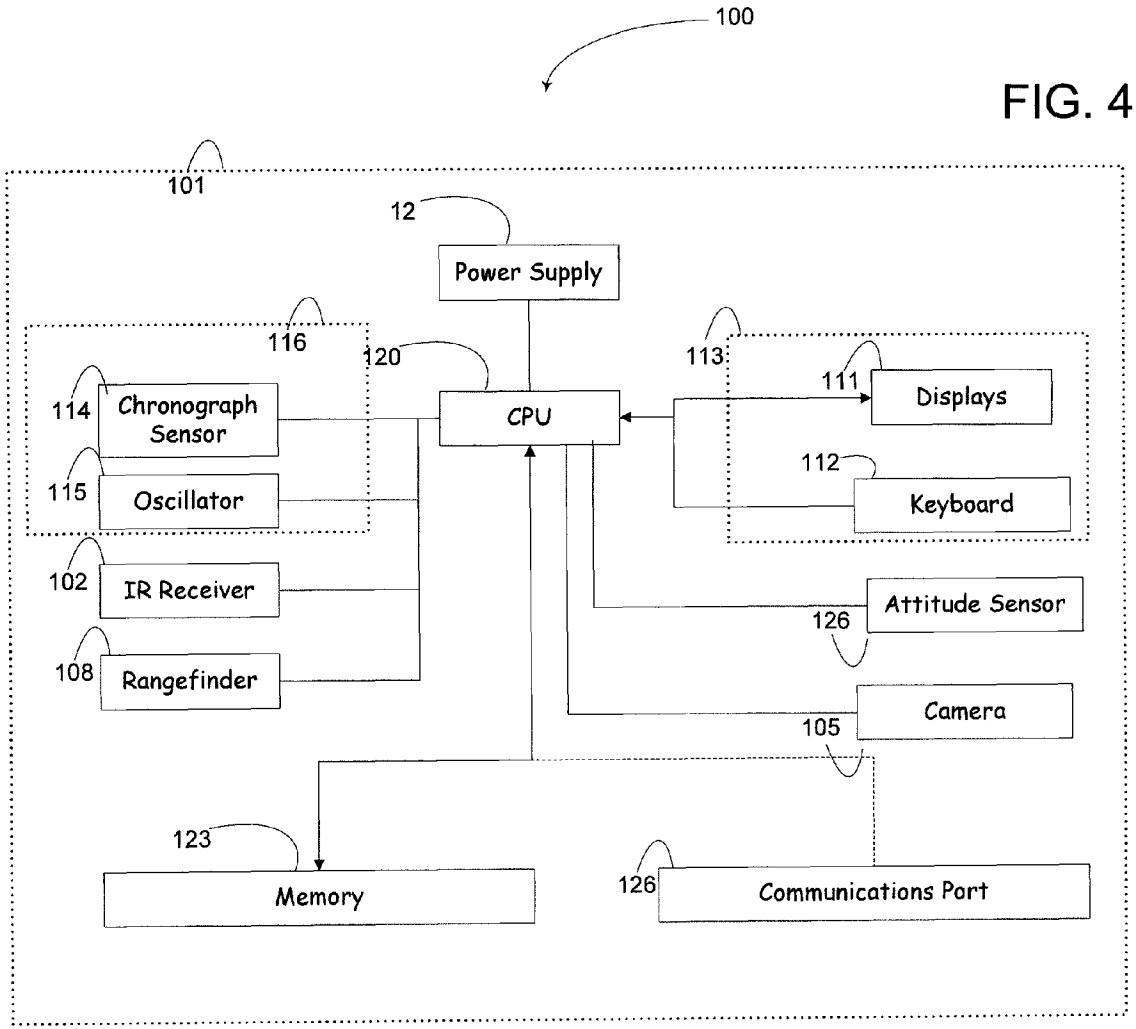
FIG. 4 is a block diagram of the embodiment of the sighting system.

Referring now to FIGS. 3 and 4, a method 200 of setting up the system 100 is presented. The system 100 is housed in a housing 101 and as previously discussed on the exterior of the housing, there are mounted a rangefinder 108, an IR receiver 102, and, optionally, a camera 105 (where the heads up display is embodied by a transparent OLED display, the camera is not necessary to generate an augmented reality display), a chronograph sensor 114, and a display 111.

In the presently preferred embodiment, the display is a touch screen 113 such that the display 111 also fulfills the keyboard 112 functionality. The touch screen display 113 is one option for providing a hardware interface between the user and the system 100. Control wheels, jog wheels, trackballs, and joysticks might also be used in concert with or in lieu of the keyboard 112 to fulfill the inputting function. In some embodiments of the system 100, the display 111 is a plurality of displays. For purposes of explanation of these several embodiments of the system 100, the discussion of the one or more of the plurality of the displays 111 and the user interaction with the keyboard 45, will be set forth by way of nonlimiting exemplary embodiment using the touch-sensitive screen assembly or touch screen 113 as comprising both the keyboard 112 and the display 111 of the user hardware interface.

Within the housing, there are, additionally a central processor 120 connected to memory, an oscillator 115 to provide a time hack to the chronograph sensor 114 to provide the function of the chronograph 116, an attitude sensor 126 to detect the attitude of the system relative to level, and a power supply 120. In an embodiment, there is additionally a communications port 123 that might either be a hardware port such as a Uniform Serial Bus (USB) port or a radio communications port such as a Bluetooth™ port. In either regard, the port allows communication with the system, either for downloading data accumulated in memory 123 during use or for uploading information such as firmware updates to the memory 123. Each of these components will be referred to throughout the explanation of the method 200 of using the system 100 and are provided here to better define the interaction of the hardware components.

As an arrow shot from a bow is essentially a ballistic projectile. As such, the single biggest variable in performance of the bow will be the speed at which the arrow leaves the bow. Generally speaking the 300 fps mark seems to be the benchmark for high performance in the archery market. As a matter of consumer perception, a bow that shoots under 300 fps is generally considered slow, while a bow that shoots over 300 fps considered fast. Manufacturers generally rate their bows using the same IBO (International Bowhunting Organization) Standard. To get an accurate IBO Speed rating, manufacturers must test their bows under the same preset conditions: setting the bow for exactly 70# Peak Draw Weight, exactly 30" Draw Length, and they must shoot a test arrow that weighs precisely 350 grains. This levels the playing field on basic settings, so the differences in IBO scores reflect other design attributes (brace height, cam aggressive, bow efficiency, etc.).

Stated speed is not, however, the speed at which a particular archer using a particular bow to fire a particular arrow. Habits of an archer affect the speed. On the most basic level, there are three main components of actual arrow speed: draw weight, draw length, and arrow mass. The higher the draw weight—the faster the arrow will shoot. The longer the draw length—the faster the arrow will shoot. And the lighter the arrow—the faster it will go. So for the purposes of testing, a slick manufacturer could setup a particular model bow and establish their bow's advertised speed using an unrealistic 100# draw weight, 32" draw length, and shoot an anorexic 250 grain arrow. None of this helps to determine what this particular archer can do.

For this purpose, the method 200 commences at a block 201 where the processor 120 generates a prompt on the display 111 to the user to enter a bow speed. The user may either enter a known bow speed, based upon the user's own experience with the bow, through the keyboard 112 or elect to test the speed using the chronograph 116 and elects to do so at a block 204. Should the archer elect not to test the bow speed, the archer enters the speed, by means of the keyboard 112 at a block 207. Once stored, the element of speed is now configurably stored until the archer elects to retest the speed.

Figure 5:
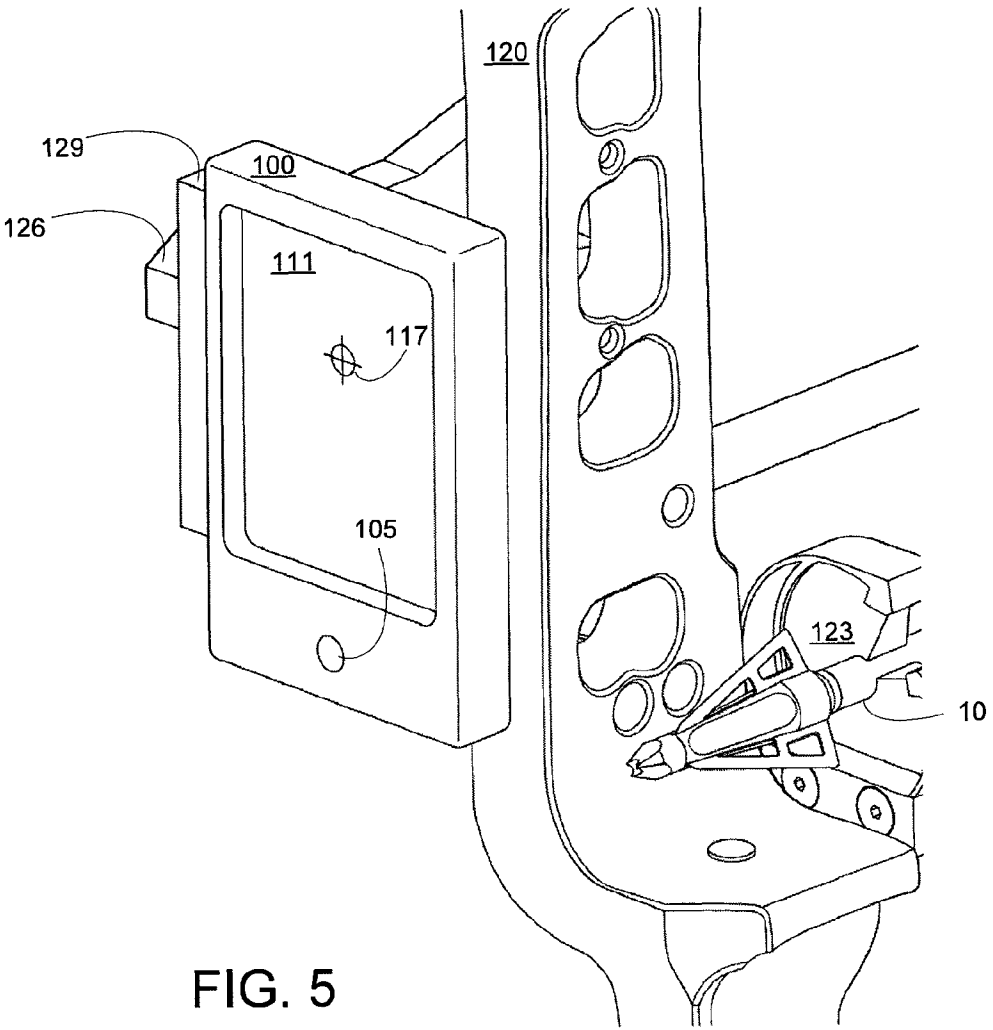
FIG. 5 is a perspective view of the arrow, the system, a mount and a bow in use.
Figure 6:
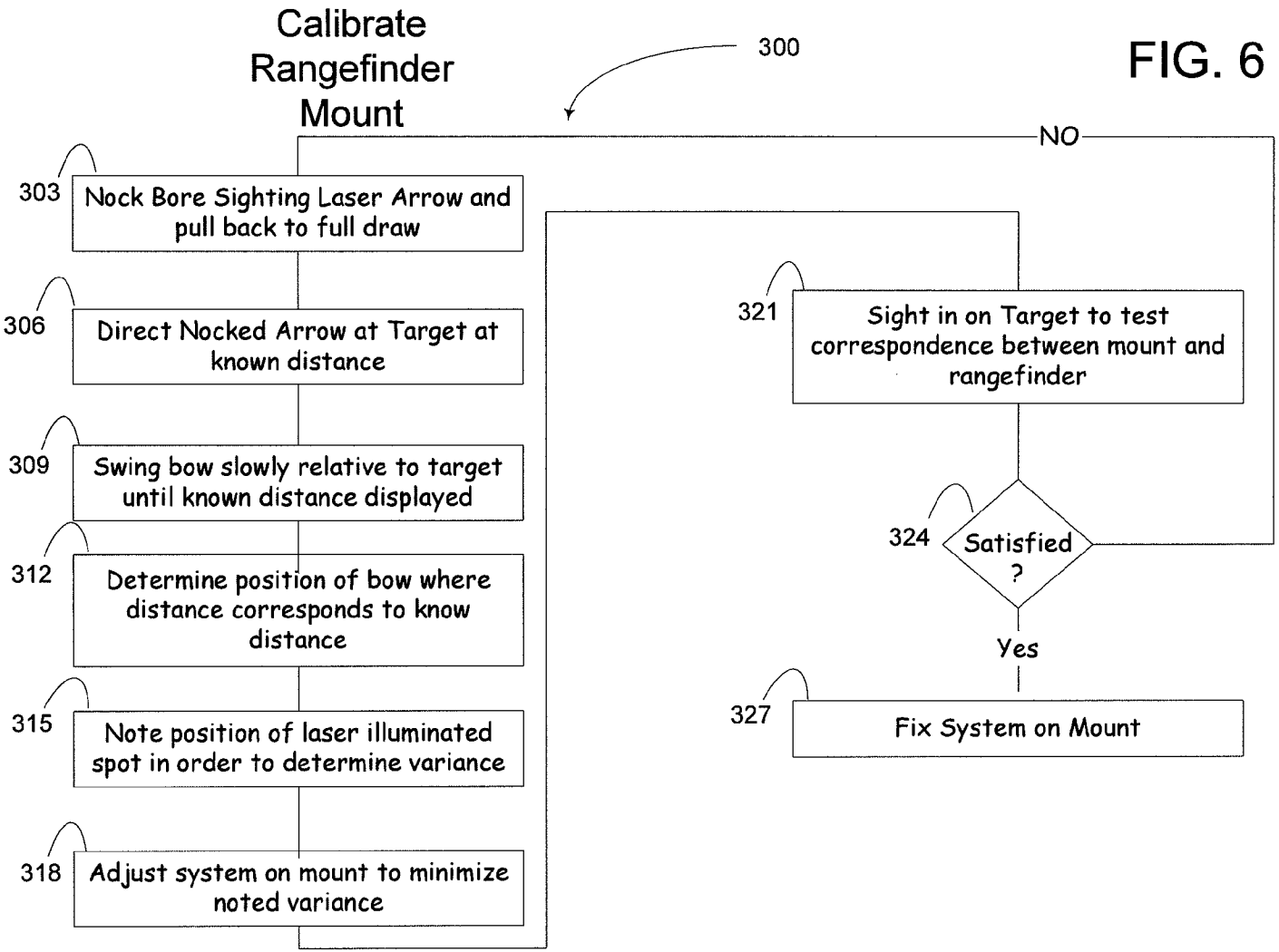
FIG. 6 is a flow chart of a method for calibrating a range finder mount.

Referring to FIGS. 4, 5, and 6, the system 100 is mounted on the bow 120 and fixing of the system 100 on the mount 126 is suitably achieved by the mount calibration method 300. The efficacy of the system 100 relies upon a fixed spatial relationship between the system's 100 rangefinder 108 and the ballistic weapon itself, such as the bow 120. Generally, this is achieved by a rigid mount 126 and a gimbal 126 with two-axis adjustment capability. Exploiting the two-axis adjustment capability, the method 300, tightly relates the position of the system 100 relative to the bow 10 by iterative searching for a target at a known distance.

The housing 101 is fixed to the mount 126 in the archer's best approximation of suitable alignment relative to the bow 120 and arrow rest 123. Once mounted, the archer will now fine tune the mount in accord with the mount 126 calibration method 300.

At a block 303, the archer nocks the bore sighting laser arrow 10 and draws the bow to full draw in accord with the archer's regular recurrent pattern of shooting. As with any form of shooting, repetition with precise accuracy is the key. The United States Marine Corps teaches this using the Breathe, Relax, Aim, Slack, Squeeze (or B.R.A.S.S. for short) in Primary Marksmanship instruction. One of the major goals of this technique is to achieve the proper mindset for taking a shot at a target. Practicing these steps repetitively leads to consistency in performance. The archer at this block is to pull the arrow back as the archer does as consistently with the archer's normal shooting either on the range or in the field.

Figure 8:
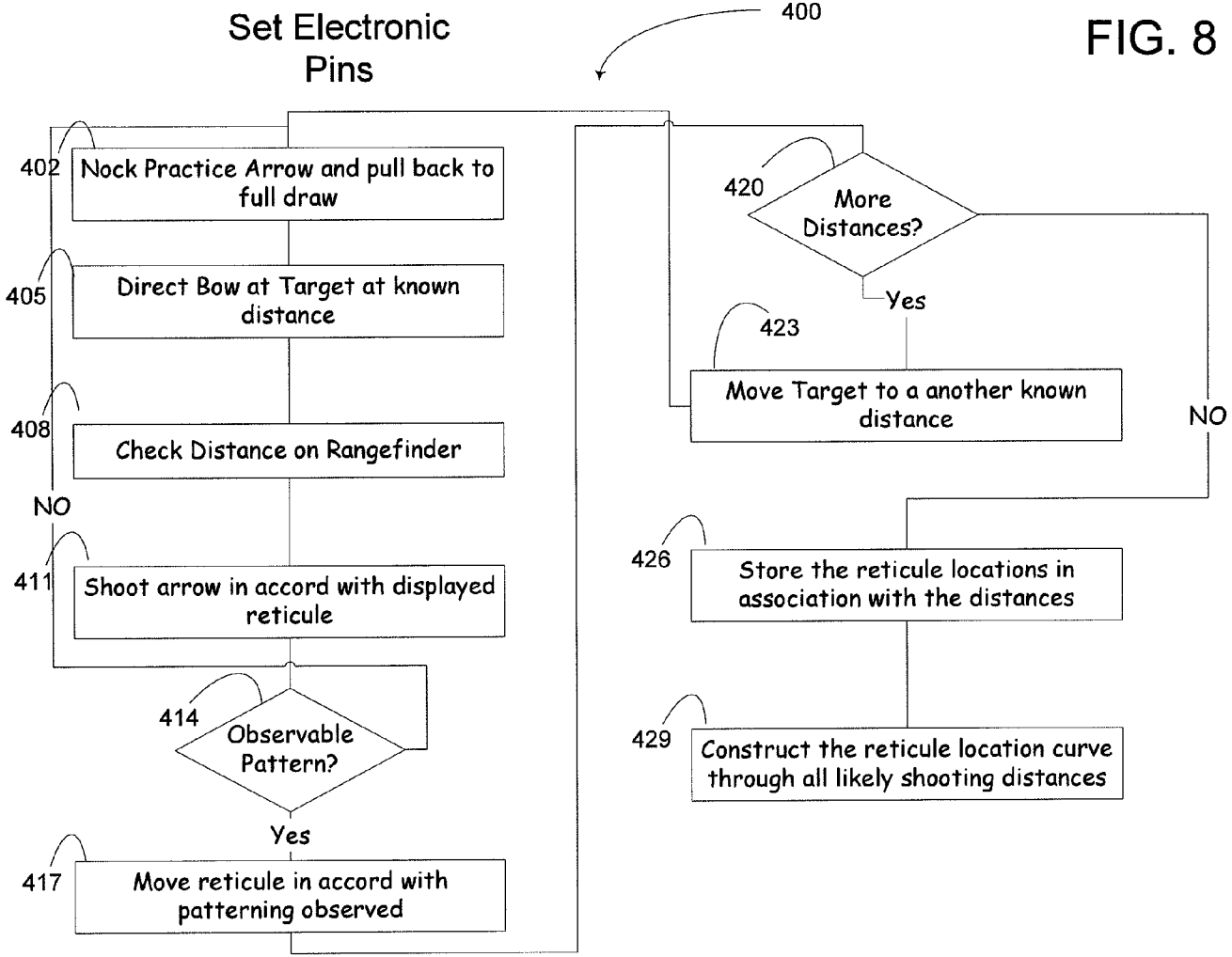

Similarly the archer, at a block 306, sights in on a known target in accord with the system 100 in its state without stored reticule locations (storing is discussed in association with FIG. 8 below). The archer directs the bore sighting laser arrow 10 such that the arrow 10 projects a laser dot on a target at a known distance. In most instances, the known distance is generally selected to be 20 yards though any selectable distance can be used as the convention. Among archers, 20 yards is generally selected to be the reference point known as "point blank." In external ballistics, point-blank range is the distance between an archer and a target of a given size such that the arrow in flight is expected to strike the target without adjusting the elevation of the bow. The point-blank range will vary with the bows and an arrow's particular ballistic characteristics, as well as the target chosen. At the block 306, the resulting position of the bow at full draw relative to the target should be aligned with the target at the point blank range. What remains in the method 300 is to align the system 100 on its mount with the bow and the bore sighting laser arrow 10 as it is projecting the laser dot on the target. This same block 306 position is achieved at a step 321 and a step 408 each discussed below.

At a block 309, the archer observes the indicated distance on the rangefinder 108 as shown on the display 111. If the rangefinder and the known distance agree, the archer has achieved the suitable mounting and there is no reason to further perform the method 300 for calibrating the position of the housing 101 relative to the bow on the mount.

Where the distance does not agree, the archer will begin a seek for the target by swinging the bow relative to the target to find the precise position necessary in order to make the rangefinder distance correspond to the known distance. The precise position of the housing 101 relative to the target is found at a block 312. In most instances, if the archer has suitably aligned the housing relative to the target, the precise block 312 position necessary will not be a great departure from the block 306 position. While in the precise block 312 position, the archer notes the second position of the laser dot relative to the target. The archer observes the vector that represents the displacement of the laser dot from the block 306 position to the 312 position at a block 315. At a block 318, the archer adjusts the mount in accord with the vector that represents the displacement of the laser dot from the block 306 position to the 312 position at a block 315. Once adjusted, at a block 321, the archer again sights in on the target as in the block 306. At a block 324, the archer observes whether the rangefinder distance now corresponds to the known distance. If, at the block 324, the archer is satisfied, the archer then locks the housing on the mount relative the bow at a block 327. If the archer is not satisfied at the block 324, the method 300 is iterated to further fine tune the position of the housing 101 relative to the bow until at the block 324, the archer is satisfied and progresses to the block 327 to fix the housing relative to the bow.

Once the housing 101 is fixed relative to the bow in accord with the method 300, the archer will advantageously place electronic pins for known distances and in accord with the distance stored in accord with the method 200 at the block 222. In conventional sighting of a bow, the fixed pin sight is the most common and the more popular choice among bowhunters. A fixed pin sight usually has 3-5 individual pins, and each pin can be set for a particular distance. The top pin for the closest distance and the bottom pin for the furthest distance. Once set they remain fixed in a particular position.

In conventional use of the fixed pin sights, the set up and adjustments on a fixed pin are pretty simple, but at the same time requires a little trial and error to get the perfect setting. Most archers will set this type of sight at easy to remember distances like 5 or 10 yards and once set, shooting one of the set distances is a very easy. The challenging part comes when shooting an unknown distance, where an archer must extrapolate a position between two bracketing distances based upon an estimate of the distance to the target. There are many variables that come into play here, uneven ground, an elevated position and dense foliage.

The inventive sight will extrapolate the distance based upon the rangefinder distance as the mount has been suitably fixed relative to the bow at the block 327. In the method 400, the archer will establish at least a first known reticule position based upon a first known target distance and a second known reticule position based upon a second known distance. The purpose of the first known reticule position and the second known reticule position is to establish for a standard arrow flying in still air at a known temperature, the characteristic flight path. Once known, the invention can suitably extrapolate a reticule position based upon distances distinct from either the first known target distance and the second known target distance. As discussed below, the processor 120 can use statistical methods to vary a reticule position based upon variations in arrows, angle of a line from the bow to the target relative to a horizon, a wind speed vector, or an ambient air temperature.

The archer nocks a first practice arrow and extends to full draw at a block 402. As at the block 306, the archer directs the bow at the target at a block 405. As an optional step, the archer, may, at a block 408, check the rangefinder as the distance is shown on the display 111 for correspondence with the known distance. At a block 411, the archer shoots the practice arrow at the target, for effect in accord with an unmodified reticule positioned in accord with the known distance. The purpose is to find out where the archer shoots arrows when shooting in accord with the reticule as currently positioned in its "factory default" position.

Figure 7:
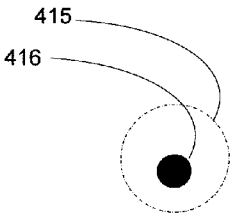
FIG. 7 is a diagram of an arrow pattern on a target.

The archer will iterate the shooting of practice arrows until at a block 414, the archer is satisfied that the shot arrows are arrayed in a suitable pattern. Referring to FIG. 7, a pattern 415 is noted as the arrows are arrayed in a target 416. As with the displacement of the laser dot, the archer noted at the block 315, the archer now observes the vector that represents the displacement of the pattern from the center of the target to where the unshifted reticule directs the archer to shoot. At a block 417, the archer adjusts the reticule position in accord with the vector that represents the pattern as shot according the reticule position, from the center of the target.

The archer iterates the process from the block 402 to block 417 for a number of selected distances at the block 420. Once collected, the several reticule positions represent a curve in space where an x- and y-axis reticule position displacement is a function of distance. The processor 120 smoothly constructs, using known statistical methods, that curve through all usable distances of the bow at a block 429. Given that constructed curve, the reticule in use is positioned for the archer based upon the rangefinder distance to target.

Figure 9C:
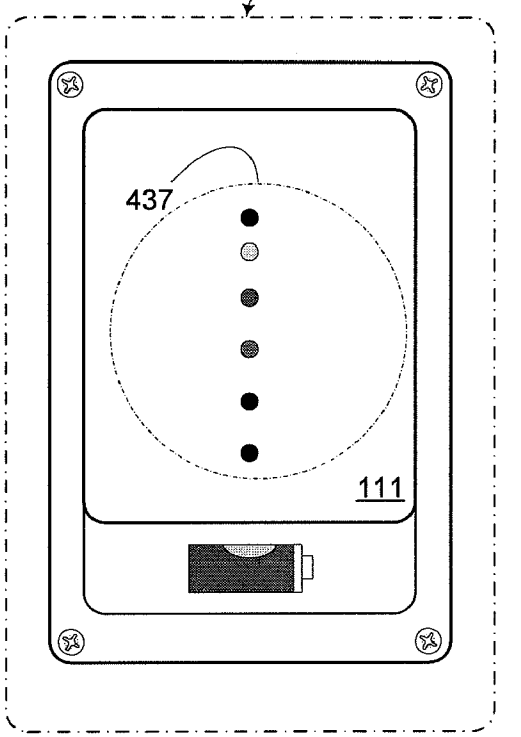
FIGS. 9*a*, 9*b*, and 9*c* are exemplary displays that illustrates various operating modes of the sighting device, in one non-limiting embodiment.
Figure 9B:
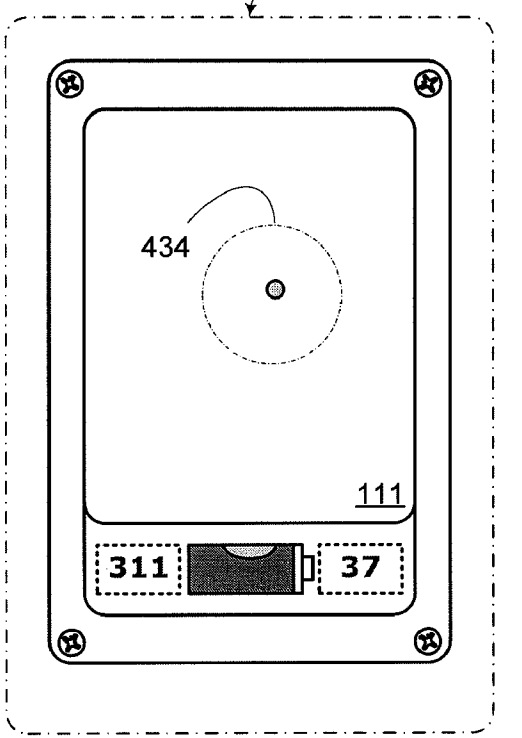
Figure 9A:
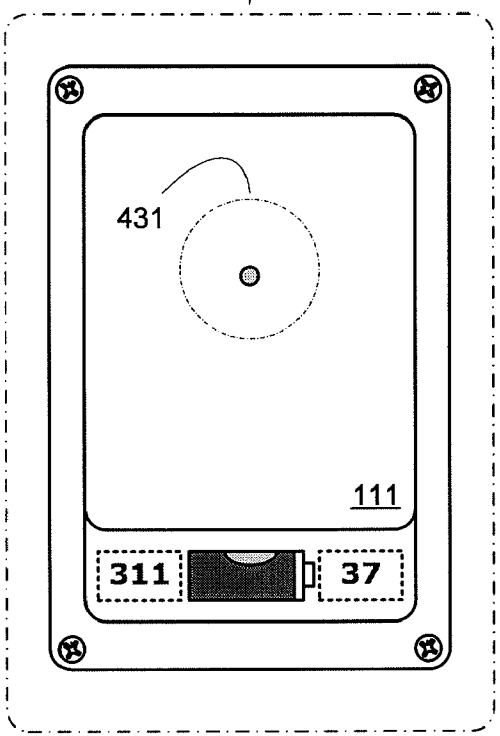

Referring now to FIGS. 9*a*, 9*b*, and 9*c*, the system 100 can generate a number of distinct reticule patterns once the correction curve is constructed at the block 429. Because each type of arrowhead commonly used by the archer has a known effect upon the flight of the arrow, and indeed, different shaft weights will likewise affect flight of an arrow once the nominal flight path has been established at the block 429. Thus, when the archer informs the system of an arrow configuration, the archer intends to use, the system can adjust the position of the reticule based upon that arrow configuration. Common means of informing the system might include optical patterns such as bar codes read at the system 100 or an RFID tag implanted upon the arrow, or by more conventional means such as inputting the arrow type on the keyboard 112. Thus, in FIG. 8*a* a reticule 431 is displayed for the use of field points. Contrast that to the positioning of a reticule 434, the processor 120 generates in response to the selected use of hunting broadheads. At the archer's option, or in the event that the rangefinder cannot locate the proper distance to the target as shown in FIG. 8*c*, the processor 120 will generate the uncorrected traditional pin series in a reticule 437.

The system may include variations in addition to those described herein. Those of ordinary skill in the art will recognize numerous modifications and substitutions that can be made to the components described herein to achieve similar results. While the preferred embodiment of the invention has been illustrated and described, as noted above, many changes can be made without departing from the spirit and scope of the invention.

In alternate embodiments, the processor 120 turns the camera 105 turns off after an optional proximity sensor has not detected an arrow for a certain period (e.g., 10 seconds). The system 100 may also include an attitude sensor that automatically adjusts the reticule based on the distance and slope (incline or decline) sensed at an attitude sensor 126 that indicates the slope of a path from the archer to the target.

In still another alternative embodiment, the camera is also used to collect video clips or photos of targets shot in time relative to the release of the arrow. Exploiting the range finder, the processor 120 may also automatically adjusts the zoom of the camera 105 as the objective lens is set according to distance; a more complex objective lens can also be autofocused in accord with the distance sensed at the rangefinder.

The processor 120 can be configured to modify the image generated on the display 111 such that the archer can select what data to view on the lower portion of the sighting system. Programmable buttons are also possible through processor 120 configuration of a touch screen display 113. For example, the touch screen display 113 is capable of displaying various information such as FPS, distance to the target (e.g., in yards or meters), and a battery life indicator as well as a digital level. The touch screen display 113 may also be optionally configured to include a digital compass, barometer, thermometer, wind direction, and wind speed. Each of these has a known effect upon the arrow and no new algorithm is set forth here for reckoning that effect. Nonetheless, the processor 120 is configured to suitably displace the reticule 117 upon the display 111 relative to each of these factors individually or the factors in concert. In one embodiment, the characterizing of the bore sighting laser arrow 10 in flight is additionally based on accelerometer reading transmitted to the system by IR/LED transmitter 18.

In further embodiments, the system 100 may include a remote wired or wireless button that the archer can attach to the grip of the bow or other convenient location and may use it to augment the keyboard. Thus, in this exemplary embodiment, when the archer presses the button, the range finder 108 scans for distance. Once the archer releases the button 13, the range finder 108 will "lock," and in response, the system 100 will display an reticule based on the correct distance to the target, and, in a further embodiment, the camera 105 will begin capturing video.

The embodiments of the invention in which an exclusive property or privilege is claimed are defined as follows:

1. A sighting system for positioning a ballistic weapon such that a projectile leaving the weapon at a known speed will strike a target downrange, the system comprising:

a bore-sight laser disposed in the projectile configured to project a laser dot downrange along an axis of the projectile, such that when the projectile is resting within the weapon, the laser dot indicates the attitude of the weapon;

a housing held in adjustably fixed position relation to the weapon, including:

a rangefinder to generate a target distance signal indicative of a target distance between the weapon and the target; and a memory to store a bow speed datum and a known reticule position based upon a known target distance;

a processor to receive the target distance signal from the rangefinder; and a display configured to depict the reticule and an electronic aiming indicator, the electronic aiming indicator replacing the reticule on the display and being located in a shifted position corresponding to the target distance signal and the eye of a user, the processor configured to generate the shifted position in response to the target distance signal, the bow speed datum and the known reticule position, such that the user sees the electronic aiming indicator overlaid on an image of the target in the shifted position indicating an attitude of the weapon necessary for the projectile to strike the target; and a mount to hold the housing in the adjustably fixed position relation to the weapon, the adjustably fixed position being selected based upon the position of the laser dot when the projectile is resting in the weapon.

2. The system of claim 1, wherein the housing further including a chronograph comprising:

a sensor for sensing the presence each of both of a first reference and a second reference on the projectile as the projectile passes the sensor; and an interval timer to determine a temporal interval between the passage of the first reference and the passage of the second reference past the sensor; and wherein the processor is configured to store the bow speed datum in memory based upon the temporal interval.

3. The system of claim 2, wherein:

the weapon includes a bow;

the projectile includes an arrow; and the bore sight laser further includes an arrow shaft.

4. The system of claim 1, wherein the display is a transparent Organic Light Emitting Diode ("OLED") display positioned between the target and the eye of the user such that the processor generates the electronic aiming indicator on the transparent OLED display and the user observes the target by gazing through the transparent OLED display.

5. The system of claim 1, wherein the display is an LCD display and wherein the housing further includes a camera in operative communication with the LCD display and being aimed in accord with the position of the housing relative to the weapon such that the LCD display generates an image of the target upon which the processor generates the electronic aiming indicator at the shifted position and the image of the target on the display is magnified in response to the target distance signal.

6. The system of claim 4, wherein the transparent OLED display includes a coating to enhance the visibility of the target through the transparent OLED display.

7. The system of claim 1, wherein the processor generates the electronic aiming indicator at the shifted position based upon the attitude of the weapon relative to a horizon.

8. The system of claim 1, wherein the processor generates the electronic aiming indicator at the shifted position based upon a temperature of the ambient air.

9. The system of claim 1, wherein the processor generates the electronic aiming indicator at the shifted position based upon a wind speed vector.

10. The system of claim 1, wherein the processor generates the electronic aiming indicator at the shifted position based upon the projectile.

11. A method for aiming a hunting projectile to strike a target positioned downrange, the projectile being emitted ballistically from a weapon at a bow speed, the method comprising:

retrieving a bow speed datum from a memory;

displaying a reticule on a display operatively coupled to the weapon;

storing in memory a reticule position based upon a known target distance;

projecting from a bore-sight laser disposed in the hunting projectile a laser dot downrange along an axis of the projectile;

determining a measured distance from the weapon to the target based upon the laser dot;

extrapolating an aiming indicator position based upon the bow speed datum and the attitude of the weapon, the stored reticule positionand the known target distance;

replacing the reticule on the display with an electronic aiming indicator positioned at the extrapolated aiming indicator reticule position on a display such that a user can view the electronic aiming indicator overlaid upon a view of the target, the extrapolated aiming indicator position indicative of an attitude of the weapon suitable to have the hunting projectile strike the target.

12. The method of claim 11, wherein extrapolating the aiming indicator position is further based upon at least one of a group consisting of arrow type, angle of a line from the bow to the target relative to a horizon, a wind speed vector, and an ambient air temperature.

13. The method of claim 11, wherein the retrieving of a bow speed datum further includes:

receiving a first chronograph reference signal at a chronograph sensor, the chronograph reference signal indicative of a chronograph reference on the projectile passing the chronograph sensor;

receiving a second chronograph reference signal at the chronograph sensor, the second chronograph reference signal being separated temporally from the first chronograph reference signal by a temporal interval; and storing a bow speed datum interval in memory, the bow speed datum being based upon the length of the temporal interval.

14. The method of claim 11, wherein the replacing the reticule includes generating an electronic pin upon a transparent Organic Light Emitting Diode ("OLED") display through which the target is visible to the user.

15. The method of claim 11, further comprising the generating of an alphanumeric legend on the display representative of at least one of a one of the group consisting of arrow type, angle of a line from the bow to the target relative to a horizon, a wind speed vector, and an ambient air temperature.

16. The method of claim 11, wherein the replacing the reticule includes:

capturing an image of the target from the weapon at a camera;

generating the image of the target with the electronic aiming indicator depicted thereon when viewed by a user; and magnifying the image of the target on the display in response to the target distance signal.

17. An apparatus for generating an electronic aiming indicator a reticule on a display at a calculated reticule position, the calculated position being selected to indicate an attitude for a bow, the apparatus comprising:

the display mounted on the bow in an adjustably fixed relation and configured to selectively display a reticule and the electronic aiming indicator;

a memory including, in machine readable storage, a bow speed datum, a first reticule position for displaying a reticule on the display such when a user views the target at a known target distance and elevates the bow such that the reticule overlays the target, the arrow released from the bow at the bow speed strikes the target;

a rangefinder for determining a target distance between the bow and the target, the rangefinder projecting from a bore-sight laser disposed in the projectile, a laser dot downrange along an axis; and a processor for extrapolating the calculated position for distances distinct from the known target distance based upon the bow speed, the known target distance and the reticule position the reticule being replaced on the display with the electronic aiming indicator in the calculated position.

18. The apparatus of claim 17, wherein the processor is configured to extrapolate the calculated position further based upon at least one of a one of the group consisting of arrow type, angle of a line from the bow to the target relative to a horizon, a wind speed vector, and an ambient air temperature.

19. The apparatus of claim 17, wherein the display includes a transparent OLED") display and is mounted on the bow such that the user can visualize the target through a transparent portion of the display.

20. The apparatus of claim 17, further comprising a camera mounted on the bow to capture an image of the target for underlying the electronic aiming indicator at the calculated position, the image of the target to approximate an image of the to be visualized by the user when holding the arrow at a fully drawn position and the image of the target on the display being magnified in response to the target distance.

* * * * *